US006341911B1

(12) United States Patent
Shueh

(10) Patent No.: US 6,341,911 B1
(45) Date of Patent: Jan. 29, 2002

(54) WRITING INSTRUMENT WITH ADJUSTABLE SHAFT

(76) Inventor: Ho-Yuan Shueh, 5F, No. 1, Alley 2, Lane Szu Wei, Chung Cheng Rd., Hsintien City, Taipei Hsien (TW)

( * ) Notice: Subject to any disclaimer, the term of this patent is extended or adjusted under 35 U.S.C. 154(b) by 0 days.

(21) Appl. No.: 09/875,168

(22) Filed: Jun. 7, 2001

(51) Int. Cl.[7] ..... A46B 5/02
(52) U.S. Cl. ..... 401/6; 16/430
(58) Field of Search ..... 401/6; 16/431, 16/430

(56) References Cited

U.S. PATENT DOCUMENTS 6,146,038 A * 11/2000 Mittersinker et al. ..... 40/6
6,158,910 A * 12/2000 Jolly et al. ..... 401/6

* cited by examiner

*Primary Examiner*—David J. Walczak
(74) *Attorney, Agent, or Firm*—Jacobson Holman, PLLC

(57) ABSTRACT

A writing instrument with an adjustable shaft comprising a barrel, a grip and a head connected by threaded head to form a pen shaft, along with a switch for retrieving or retracting the pen point of the cartridge by clicking or turning a button, and a soft rubber gripping section covering the grip. A driver is installed under the switch inside the barrel, and a few support rods are put inside of the grip. When holders click the button to press the switch, the driver, in turn, pushes the top of the support rods, making the support rods prop the soft rubber gripping section into the shape of an ergonomic arch. When the button is clicked again, the shaft returns to the original shape of a cylinder.

1 Claim, 5 Drawing Sheets

WRITING INSTRUMENT WITH ADJUSTABLE SHAFT

BACKGROUND OF THE INVENTION

I. Field of the Invention

This invention relates generally to a writing instrument with an adjustable shaft and, more specifically, to a writing instrument with a shaft that is originally in the shape of a cylinder and can be molded into an ergonomic shape when the pen point is retrieved for writing, providing a comfortable writing experience.

II. Description of the Prior Art

Heretofore, it is known to construct a writing instrument in the shape of a straight tube and made of hard plastic or metals. A writing instrument of such construction is not ergonomically designed and tends to generate uncomfortable feelings, especially when holders write for a relatively long period of time.

It is also known to construct a writing instrument of which the shape of the shaft is designed ergonomically. Nonetheless, the look of an ergonomically designed writing instrument may not be desirable to consumers.

The present invention improves on the heretofore known writing instrument by providing a pen shaft with variable shapes that offers extended writing comfort as well as stylish pen design.

SUMMARY OF THE INVENTION

It is therefore a primary object of the invention to provide a writing instrument having an ergonomically designed shaft with a graceful look. The shaft of the present invention is composed of a barrel, a grip and a head, fitted together by the threaded head. A switch that retrieves and retracts the pen point of the cartridge is installed in the barrel and is connected to a driver. The grip is covered with a soft rubber gripping section.

A few long and narrow holes are located at equal intervals inside the grip close to the threaded head. Near the lower end of the holes are ditches. Vertically positioned support rods are accommodated in the ditches outside the grip. The bottom of the support rods goes into the ditches, and the top of the support rods goes upwards through the holes and sticks out slightly into the threaded head reaching the driver.

As holders click or turn the button for the first time, the switch pushes the cartridge and the driver downwards, and in turn the driver pushes the support rods downwards, making the support rods bend and prop the soft rubber gripping section into the shape of an arch. To undo the action, holders click or turn the button again so that all the components go back to their original positions, and the shaft returns to the shape of a cylinder.

BRIEF DESCRIPTION OF THE DRAWINGS

An embodiment of the invention will now be described by way of example only, with reference to the accompanying drawing, in which.

DESCRIPTION OF THE PREFERRED EMBODIMENT

Figure 1:
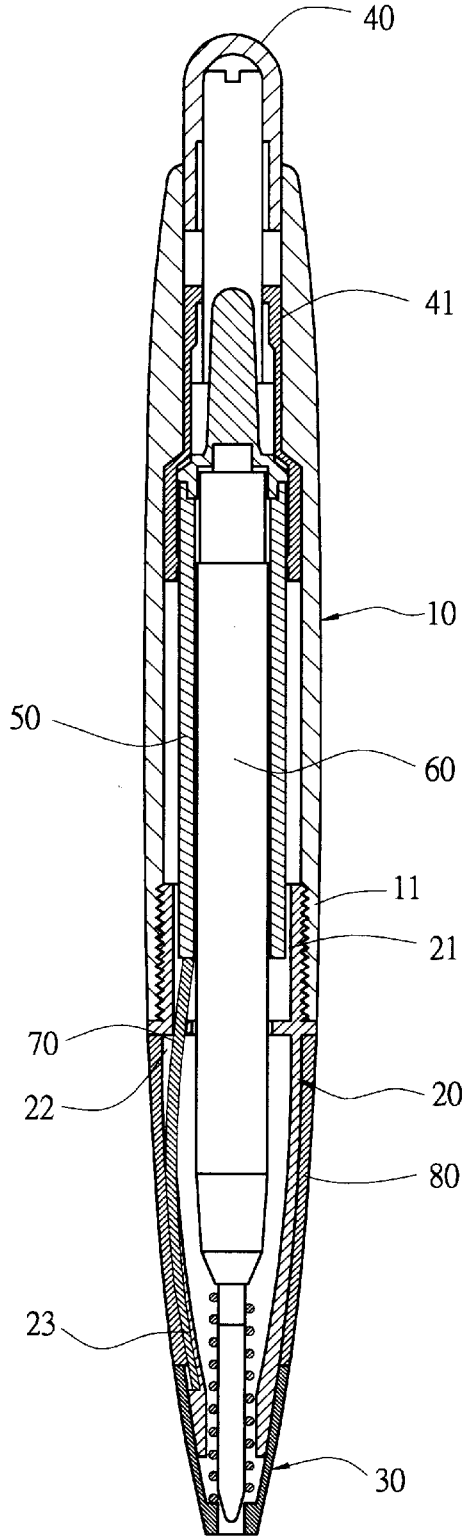
FIG. 1 is a sectional view of the present invention.
Figure 5:
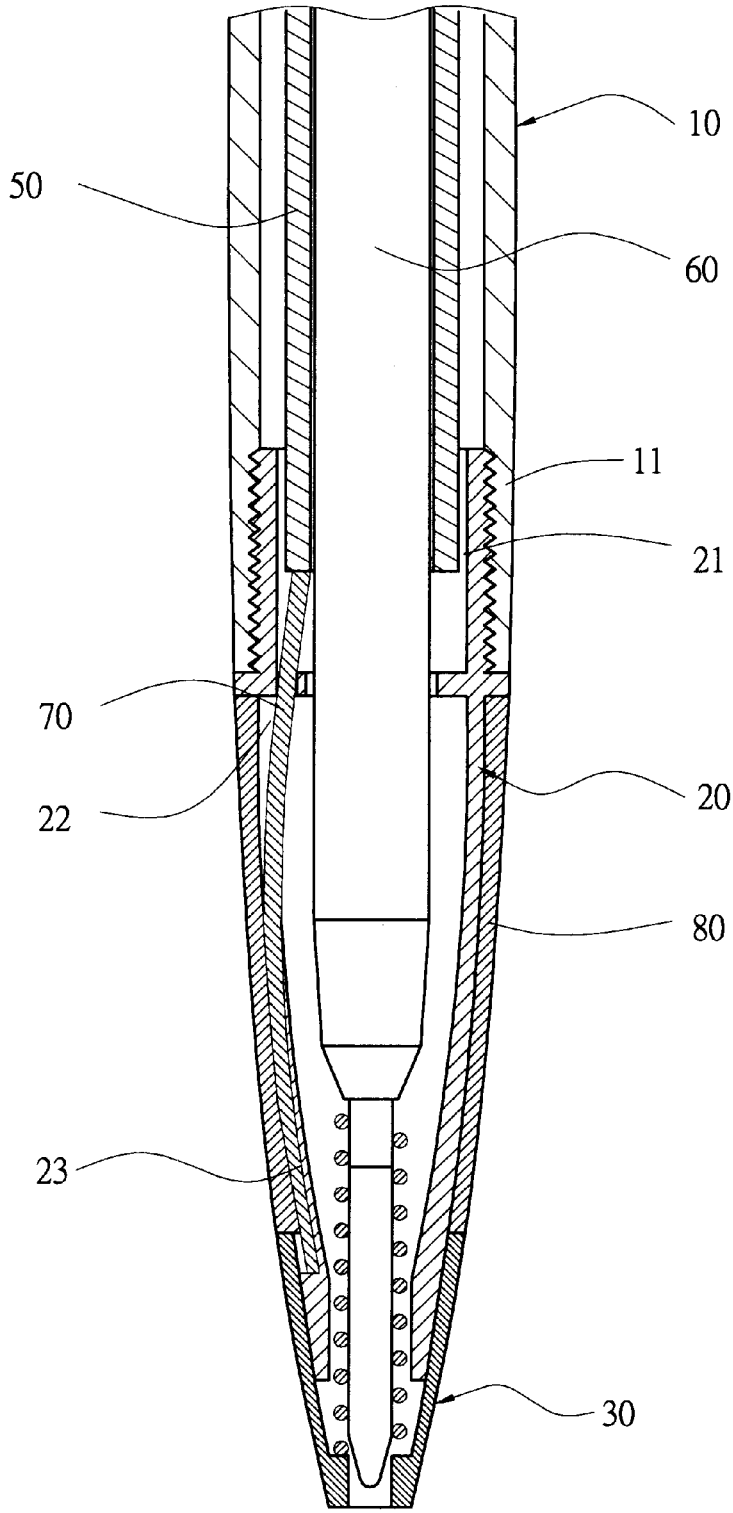
FIG. 5 is an enlarged view of the present invention.

Referring to FIG. 1 and FIG. 5, the present invention comprises a barrel 10, a grip 20, a head 30, a cartridge 60, a button 40, a switch 41, a driver 50, and a soft rubber gripping section 80.

The barrel 10, the grip 20 and the head 30 are connected together by threaded heads 11 , 21 to form a pen shaft. The cartridge 60 is put inside the shaft, and the pen point of the cartridge 60 is capped with a spring. The grip 20 is covered with a soft rubber gripping section 80, and the driver 50 is put below the switch 41 in the barrel 10.

The switch 41 is installed within the barrel 10 near the end of the cartridge 60, and the button 40 is set on the top of the switch 41. When the button 40 is clicked or turned, the switch 41 pushes to retrieve or retract the pen point of the cartridge 60 from the shaft.

Figure 2:
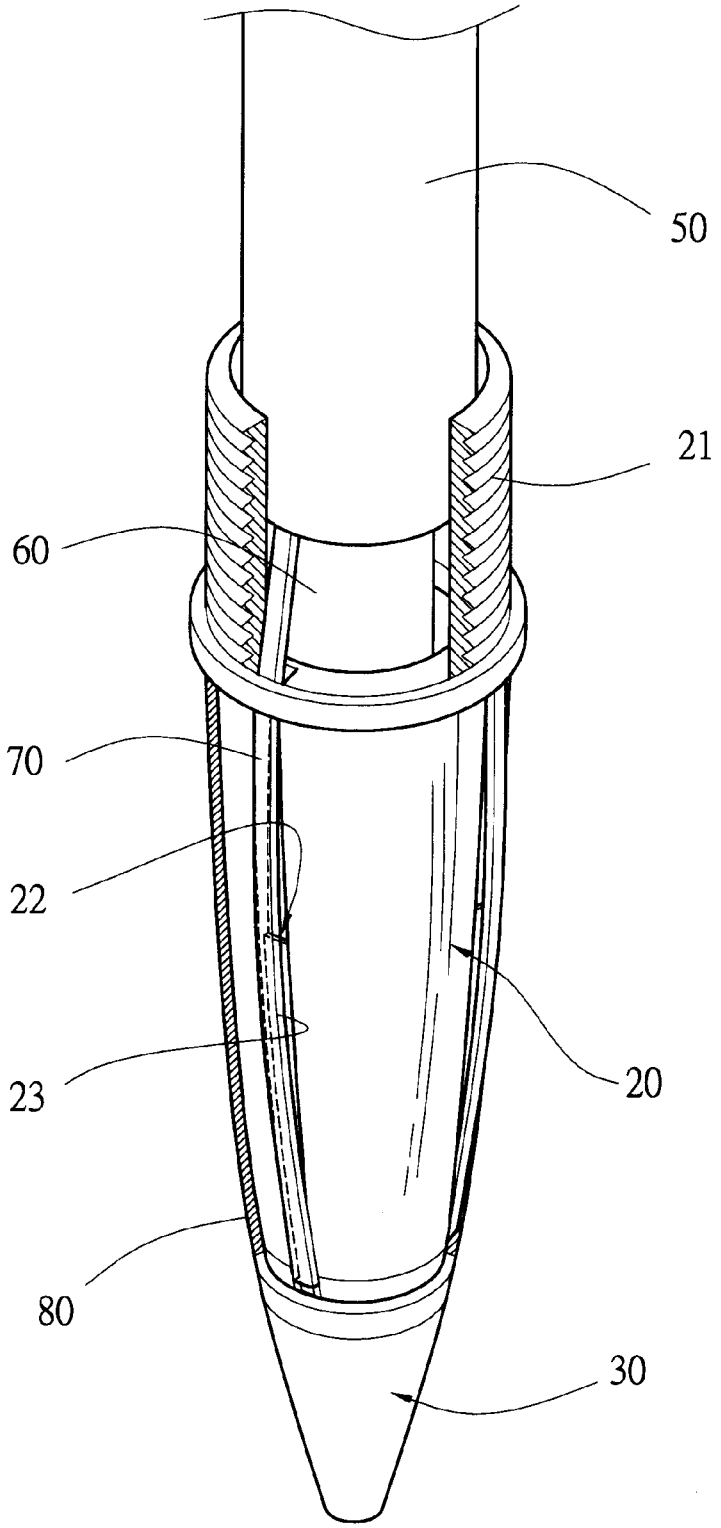
FIG. 2 is a partial elevational view of a pen according to the present invention.

Refer to FIG. 2 and FIG. 5, a few long and narrow holes 22 are disposed at equal intervals inside the grip 20 close to the threaded head 11, 21. Near the lower end of the holes 22 and outside the grip 20, there are corresponding ditches 23. A few support rods 70 are positioned vertically in ditches 23 outside the grip 20, wherein, their lower ends protrude the ditches 23, and reach the head 30. The top of the support rods 70 goes through the holes 22 and sticks out slightly into the threaded head 21 under the driver 50.

Figure 3:
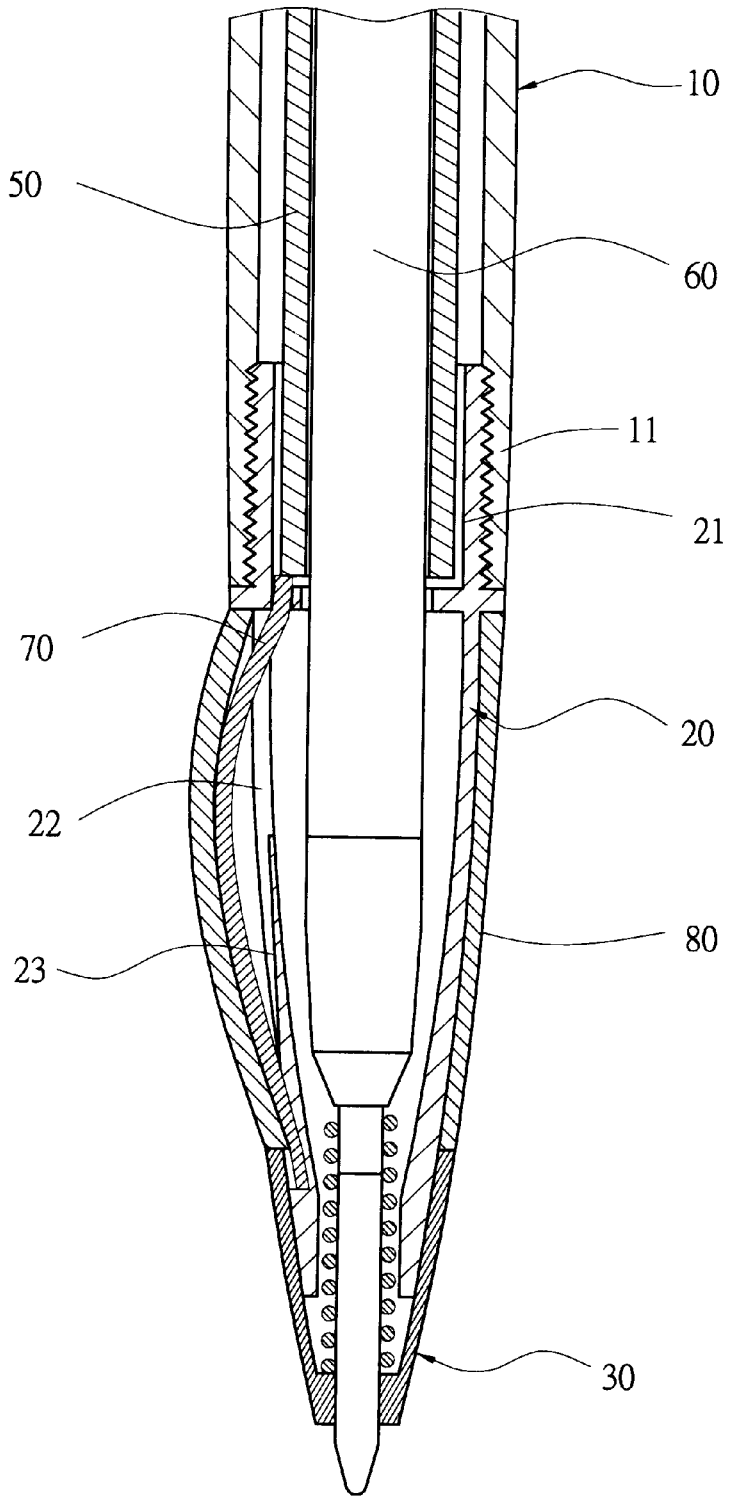
FIG. 3 shows one application of the present invention.
Figure 4:
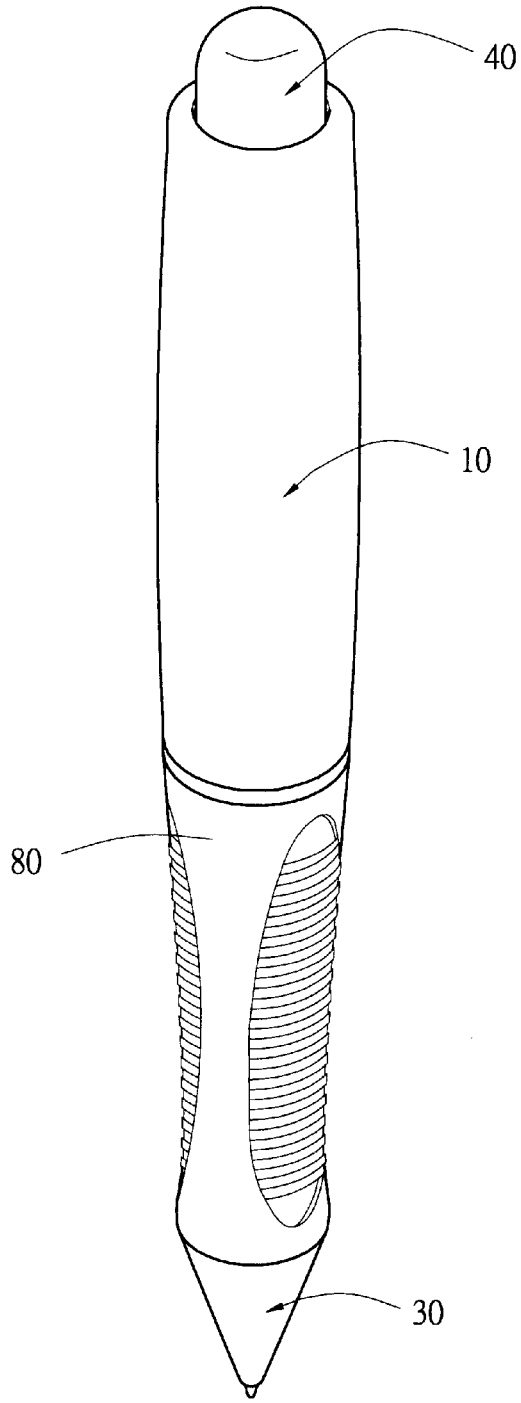
FIG. 4 is a lateral view of the present invention.

As can be seen in FIG. 1 and FIG. 3, as holders click or turn the button 40, the switch 41 pushes the cartridge 60 and the driver 50. In turn, the pen point of the cartridge 60 sticks out of the shaft, and the driver 50 pushes the support rods 70, making the support rods 70 bend and prop the soft rubber gripping section 80 to form three ergonomic arches. When the button 40 is clicked or turned again, all the components go back to their original positions, and the shape of the shaft is molded back into a cylinder.

The present invention has the advantages of providing an adjustable profile of the pen shaft. When in use, the shaft is molded into an ergonomic shape when in use and returns to the shape of a cylinder when the pen point of the cartridge is retracted.

While a preferred embodiment of the invention has been shown and described in detail, it will be readily understood and appreciated that numerous omissions, changes and additions may be made without departing from the spirit and scope of the invention.

What is claimed is:

1. A writing instrument with an adjustable shaft comprising a barrel, a grip and a head connected by threaded heads to form a pen shaft, along with a switch having a button thereof for retrieving or retracting a cartridge, and a soft rubber gripping section covering said grip, wherein a driver is installed under said switch inside said barrel;

a plurality of long and narrow holes are disposed at equal intervals inside said grip, close to said threaded head while a plurality of corresponding ditches are on the lower end of said long and narrow holes;

a plurality of support rods are positioned vertically in said ditches outside said grip, wherein, their lower ends protrude said ditches, then reach said head while the top of said support rods goes through said long and narrow holes and sticks out slightly into the threaded head under said driver;

by clicking or rotating said button of said switch, said driver, in turn, pushes the top of said support rods, making said support rods prop said soft rubber gripping section into the shape of an ergonomic arch; by contrast, when clicking said button again, said shaft returns to the original shape of a cylinder.

* * * * *